US005422452A

United States Patent [19]

Chang et al.

[11] Patent Number: 5,422,452

[45] Date of Patent: Jun. 6, 1995

[54] MOVABLE ELECTRICAL POTENTIOMETER CONTACT ASSEMBLY

[75] Inventors: Shih-Chih Chang; Wan-Liang Hu, both of Richland, Wash.

[73] Assignee: Associated Assembly, Inc., Huntley, Ill.

[21] Appl. No.: 129,661

[22] Filed: Sep. 16, 1993

[51] Int. Cl.[6] ..... H01H 1/16

[52] U.S. Cl. ..... 200/277; 200/264; 200/536; 200/550

[58] Field of Search ..... 200/264, 277, 277.1, 200/544, 240, 536, 531, 541, 550, 571

[56] References Cited

U.S. PATENT DOCUMENTS

| | | | |
|---|---|---|---|
| 3,859,488 | 1/1975 | Jones . | |
| 4,139,071 | 2/1979 | Tackett . | |
| 4,614,849 | 9/1986 | Miller | 200/277 X |
| 4,642,427 | 2/1987 | Kratz et al. | 200/277 X |
| 5,017,744 | 5/1991 | Yoshida | 200/277 |
| 5,051,549 | 9/1991 | Takano | 200/277 X |

FOREIGN PATENT DOCUMENTS

| | | | |
|---|---|---|---|
| 1540923 | 10/1968 | France | 200/277 |

*Primary Examiner*—Ernest G. Cusick
*Attorney, Agent, or Firm*—Thomas R. Vigil

[57] ABSTRACT

A movable electrical contact assembly forms a potentiometer and includes at least one strip of electrically conductive material having a significant resistance, a conductive rolling contact device in contact with the strip, a mechanism for moving the rolling contact device along the strip, and the rolling contact device or the strip being made of a deformable conductive material. In one preferred embodiment, two strips are provided at least one of which has a significant resistance. Also in one embodiment, the rolling contact device is deformable and is defined by a conductive elastomeric contact roller.

12 Claims, 3 Drawing Sheets

MOVABLE ELECTRICAL POTENTIOMETER CONTACT ASSEMBLY

BACKGROUND OF THE INVENTION

1. Field of the Invention

The present invention relates to a movable electrical contact assembly forming a potentiometer and including a movable electrical contact and at least one stationary contact having significant resistance. Preferably, the movable contact is a movable or rollable conductive element that is urged against and rolls along the stationary contacts.

2. Description of the Related Art Including Information Disclosed Under 37 CFR § 1.97–1.99

Electrical contact between moving parts is subject to friction and wear. From a mechanical point of view, high contact pressure results in high friction and consequently, severe wear. The frictional resistance of sliding one metal contact over another metal contact is due mainly to the shearing of welded junctions that are formed when the surfaces are placed in contact under load. The upper metal contact is supported on the peaks of surface irregularities on the lower metal contact, so that the real area of contact is very small. The intense local pressures produce welded junctions, even at light loads, and plastic deformation takes place until the total area over which welding occurs is sufficient to support the load without further deformation. This shearing of the welded junction is the main cause of frictional resistance. The magnitude of this effect depends on the melting points of the two metals. Small particles of metal are often detached from the sliding metal contact and adhere to the other metal contact.

It is well known from the knowledge of mechanics and experience with wear that a rolling contact produces much less wear than that of a sliding contact. However, a rolling contact has been rarely used in electric contact designs for the reasons that hard roller contacts with a hard surface basically form a line contact which can hardly produce a sufficient contact surface area under a reasonable pressure since the cylindrical configuration of the hard roller does not result in a large contact area. On the other hand, a sliding brush can be designed in an optimized configuration to produce maximum contact area under pressure. Therefore, a brush has been more desirable where contact area is concerned and it is more frequently used in practice despite the fact that it relies on sliding motion and causes more wear.

The Jones U.S. Pat. No. 3,859,488 teaches a roller band electrical switching mechanism wherein one or both of the rollers serves as a movable contact. The roller or rollers function as a contact supported and guided directly by a hollow case. The roller support and guide surfaces, or races, of the case are concavely curved and incorporate fixed contacts which have been exposed surfaces which lie flush with the roller guide surface of the case. The roller, with its ends in substantial rolling point engagement with the races, closes or opens electrical circuits as it rolls along the guide surface. The roller band in most cases does not touch the case. By thus suspending the roller so that it can serve as a movable contact, exerting great localized pressure on embedded contacts flush with the rolling support surface while producing minimal switching friction, a substantial increase of switching quality and utility is achieved.

The Tackett U.S. Pat. No. 4,139,071 teaches a roadway for automotive vehicles including means for transmitting electric current through the road surface to electrically operated vehicles travelling thereon. The vehicle employs electrically-conductive tires which roll on an electrically-conductive surface of the contact assembly, and the current thus picked up is transmitted, through rolling-sliding contacts, conductors, etc. in contact with the tires to controls for controlling the vehicle through individual wheel motors. The contact member rolls on an annular track of the tire for receiving the current while the contact member is sliding on a shaft for conducting the current into the system.

The movable electrical contact assembly of the present invention differs from the previously proposed electrical contact assemblies by including at least one conductive strip, which has a significant resistance, and a deformable rolling contact element in rollable contact with the conductive strip.

SUMMARY OF THE INVENTION

According to the present invention there is provided a compact potentiometer assembly comprising at least one strip of electrically conductive material having a significant resistance, an electrically conductive, rolling contact in contact with the strip, a mechanism for moving the rolling contact along the strip, and the rolling contact being a deformable, electrically conductive, elastomeric roller. Preferably, the potentiometer comprises a second strip spaced from and generally parallel to the first strip with the roller engaging both strips.

Further according to the present invention there is provided a movable electrical contact assembly forming a potentiometer and including at least one strip of electrically conductive material having a significant resistance, an electrically conductive, rolling contact in contact with the strip, a mechanism for moving the rolling contact along the strip and, the rolling contact being a deformable, electrically conductive, elastomeric rocker.

Still further according to the present invention there is provided a movable electrical contact assembly forming a potentiometer and including at least one strip of electrically conductive material having a significant resistance, an electrically conductive rolling contact in contact with the strip, a mechanism for moving the rolling contact along the strip and, the rolling contact being a deformable, electrically conductive elastomeric ball.

Additionally, according to the present invention there is provided a movable electrical contact assembly forming a potentiometer and including at least one strip of electrically conductive material having a significant resistance, an electrically conductive, rolling contact in contact with the strip, a mechanism for moving the rolling contact along the strip, and the strip being made of a deformable, electrically conductive, elastomeric material and the rolling contact being made of an electrically conductive metal.

DESCRIPTION OF THE PREFERRED EMBODIMENT(S)

Figure 1:
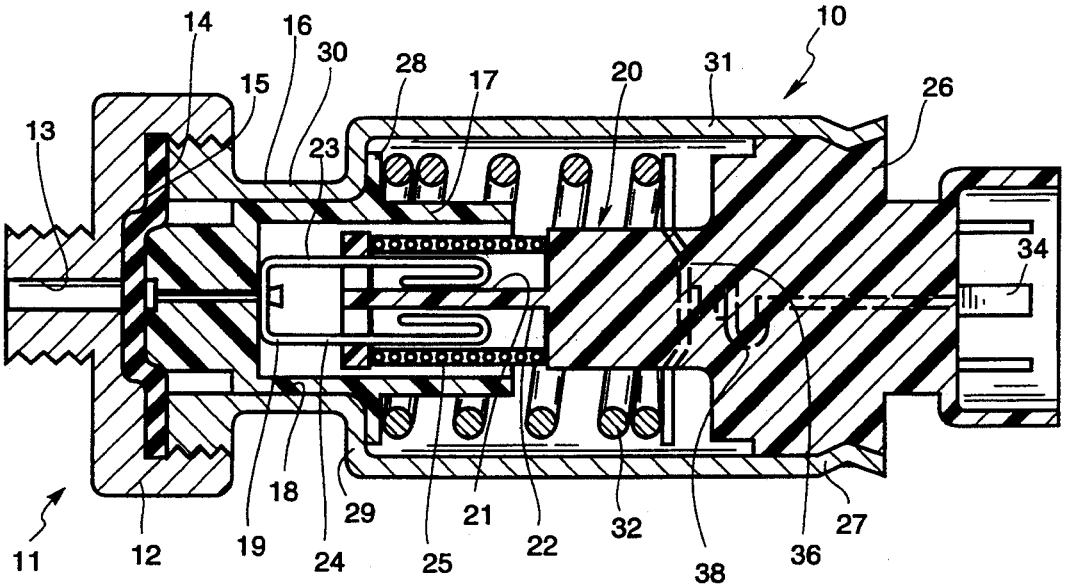
FIG. 1 PRIOR ART
FIG. 1 is a longitudinal cross-sectional view of a prior art electrical contact assembly and shows a plunger mounting a bifurcated metal contact legs of which are received into slots extending axially into a projection mounted in a casing for engaging the interior surface of a coiled conductor wound around the projection and communicating with the slots.

Referring now to FIG. 1, there is shown therein a longitudinal cross-sectional view of a prior art pressure sensing electrical contact assembly 10. The assembly 10 includes a pressure sensing unit 11 comprising an air inlet member 12 having an air inlet passageway 13. A diaphragm 14 is mounted in a cavity 15 in the member 12.

One end of a cylinder 16 is threaded into the cavity 15 against the diaphragm 14 and slidably receives a plunger 17.

The plunger 17 has a cylindrical space 18 therein mounting a bifurcated metal contact member 19 that extends axially from the bottom of the space 18 toward a cylindrical projection 20 having a pair of spaced apart axially extending slots 21 and 22 therein.

Legs 23 and 24 of the bifurcated metal contact member 19 are positioned to move into and out of the slots 21 and 22 and to engage and make electrical contact with the inner surface of coils of a coiled conductor 25 wound around the projection 20 and extending across cutaway spaces in the outer wall of the projection 20 and communicating with the slots 21 and 22.

The coiled conductor 25 and the metal contact legs 23 and 24 form a potentiometer.

The projection 20 extends to a larger diameter base 26 which is mounted in the other end 27 of the cylinder 16. The plunger 17 has an annular flange 28 which is an at rest position shown in FIG. 1 rests against an annular wall 29 of the cylinder 16 between a smaller diameter portion 30 of the cylinder 16 receiving the plunger 17 and a larger diameter portion 31 in which the base 26 of the projection 20 is received and mounted. A spring 32 is positioned between the flange 28 and an annular disc 34 which has two diametrically disposed raised areas 36 positioned to engage contacts 38 leading to terminals 39, when the plunger 17 is moved in the cylinder 16.

Pressurized air is directed linearly to the diaphragm 14 abutting plunger 17. Plunger 17 is fixed to contact member 19 having legs 23 and 24 aligned with female slots 21 and 22 in projection 20.

When diaphragm 14 is moved by pressurized fluid linearly inward of the assembly 10, the plunger 17 advances the metal contact legs 23 and 24 from a first conductive engagement position with the coiled conductor 25 to a second conductive engagement position with the coiled conductor 25, the conductive engagement position providing a voltage drop indicative of the fluid pressure being sensed. Then when the disc 34 having raised contacts 36 is axially displaced to come into contact with contacts 38 the coiled conductor 25 of the potentiometer is short circuited and the short circuit signal can be used as an alarm signal and supply to an annunciator.

In the prior art electrical contact assembly 10 illustrated in FIG. 1, electrical contact between the metal contact legs 23 and 24 and coils of the coiled conductor 25, from a mechanical point of view has high contact pressure and high friction resulting in severe wear. The frictional resistance of sliding the metal contact legs 23, 24 with the coiled conductor 25 in a shearing fashion against the coils of the coiled conductor 25 can result in failure of the electrical contact assembly 10 and a limited operational life thereof.

Figure 2A:
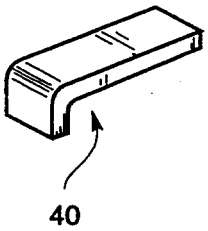
FIG. 2A PRIOR ART
FIG. 2A is a perspective view of a prior art hoe-shaped contact.
Figure 2B:
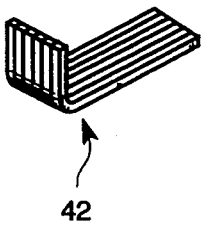
FIG. 2B PRIOR ART
FIG. 2B is a perspective view of a prior art brush-shaped contact.
Figure 2C:
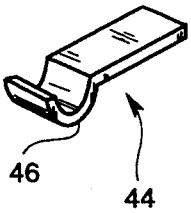
FIG. 2C PRIOR ART
FIG. 2C is a perspective view of a prior art wiper type contact having a curved, semi-cylindrical surface for being wiped across a flat stationary contact.

FIGS. 2A, 2B, and 2C are perspective views of prior art electric contact members different than the metal contact legs 23 and 24, namely a hoe-shaped contact member 40, a brush shaped contact member 42, and a wiper blade type contact member 44, which includes a curved semi-cylindrical contact portion 46, respectively, which can be used in place of the metal contact legs 23 and 24. Such electric contact members for electrical contact with a conductive surface, such as the inside of the coils of the coiled conductor 25, also provides frictional resistance and contact pressures conductive to shearing or failure of an electrical contact assembly.

Figure 3:
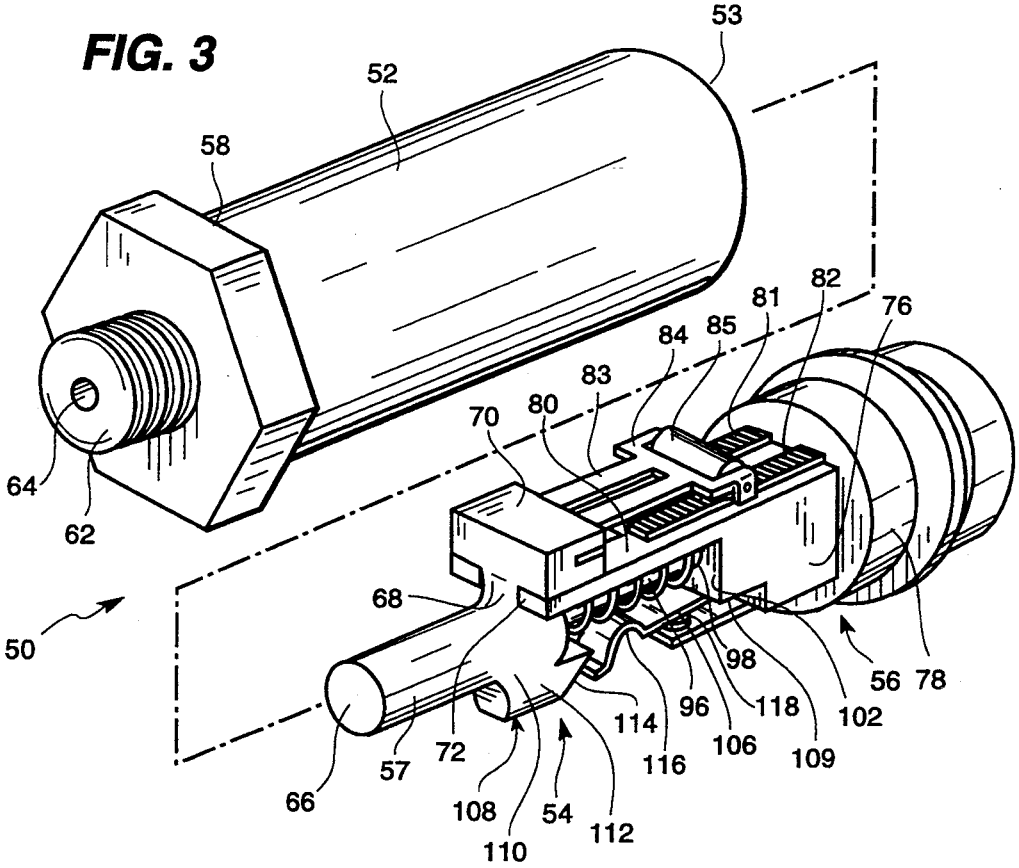
FIG. 3 is a perspective view of a movable electrical contact assembly constructed according to the teachings of the present invention and showing a casing of the assembly separated from a movable portion and a stationary portion of the assembly received in the casing.
Figure 4:
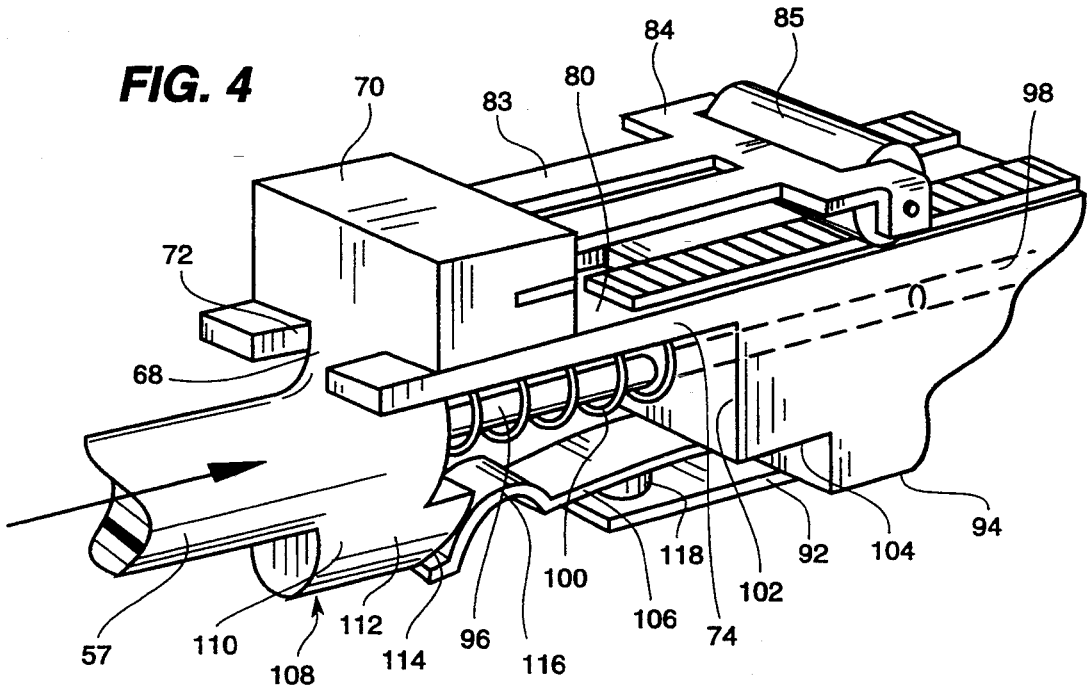
FIG. 4 is a perspective view of the movable portion and the stationary portion of the assembly.
Figure 5:
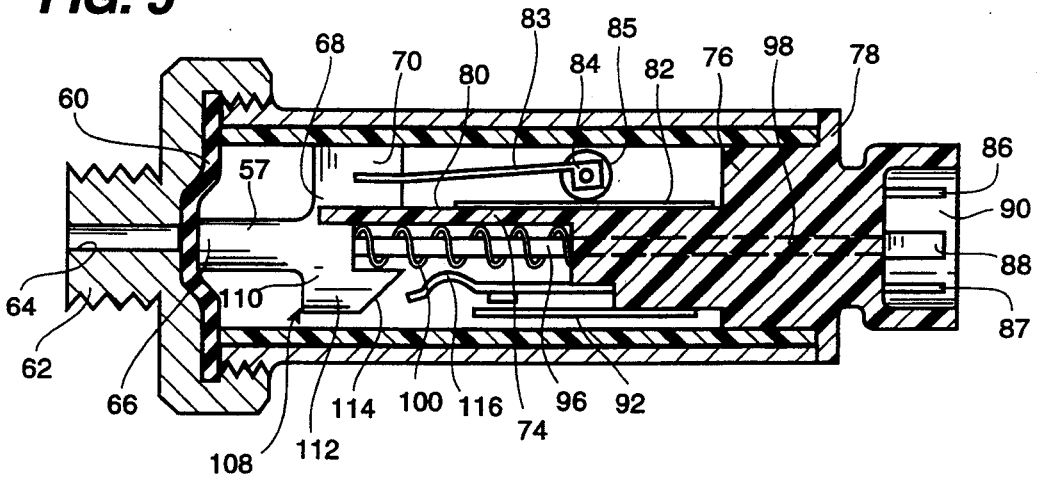
FIG. 5 is a longitudinal cross-sectional view of the assembly of the present invention and shows the movable portion and the stationary portion at an at rest position.
Figure 6:
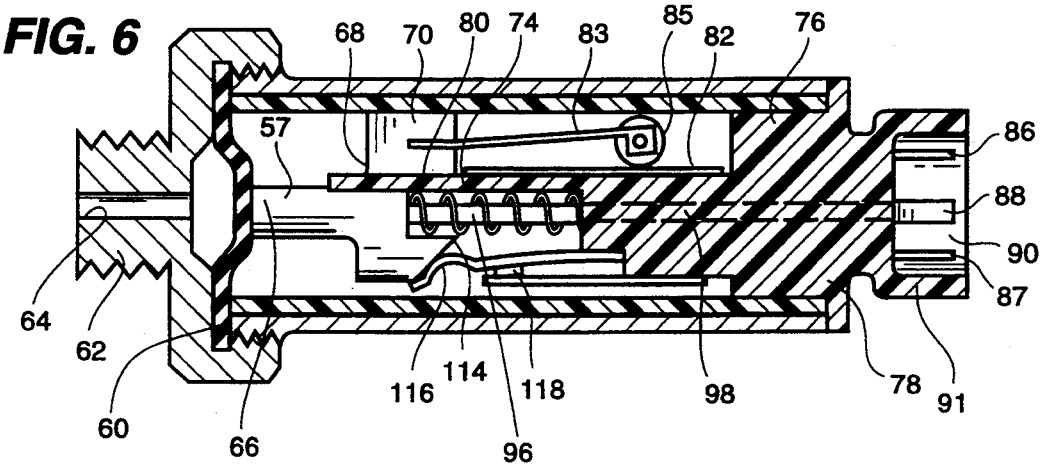
FIG. 6 is a longitudinal cross-sectional view of the movable portion and the stationary portion shown in FIG. 5 but with the movable portion moved to its maximum position by fluid pressure acting on a diaphragm which pushes the movable portion against the stationary portion.

FIG. 3 is a perspective view of a pressure sensing movable electrical contact assembly 50 forming a potentiometer and constructed according to the teachings of the present invention. The assembly 50 includes a casing member 52 having an open end 53. The movable electrical contact assembly 50 includes a movable portion 54 mounted for slidable movement on a stationary portion 56 that is received into the open end 53 of the casing 52 against a diaphragm 60 (FIGS. 5 and 6). The movable portion 54 includes a plunger or piston 57 which is received in a closed end 58 of the casing 52. A serrated or threaded nipple 62 extends from the closed end 58 of the casing 52 and has an axial air passageway 64 therethrough to the interior of casing 52 for supplying fluid pressure to act against the diaphragm 60 (FIGS. 5 and 6) to urge same against a free end 66 of the plunger 57.

An arm 68 extends radially outwardly from the plunger 57 to a head 70, the arm 68 being received in an axially extending guide slot 72 in a flange or plate 74 of the stationary portion 56 that lies in a plane parallel to the axis of the plunger 57. The flange 74 extends from a block 76 of the stationary portion 56 which is fixed to or integral with a cylindrical base 78 of the stationary portion 56. The base 78 is received in, and fixed to, the open end 53 of the casing 52.

Mounted on an outer side surface 80 of the flange 74 and coextensive block 76 and extending axially on surface 80 are two spaced apart conductive strips 81 and 82, at least one of which has a significant linear resistance.

Then, extending axially from the head 70 toward the base 78 is a spring bracket 83 having a yoke 84 mounting a conductive roller 85 at a distal end of the bracket 84. The flange 74 and block 76 integral therewith are made of an insulative material. The plunger 57 is made of a conductive metal material and the bracket 83 is made of a conductive spring metal so that the bracket 83 urges the roller 85 against the strips 81 and 82.

Terminals 86, 87 and 88 (FIGS. 5 and 6) are mounted within a cavity 90 in a cowling 91 at the outer end of the base 78 and are connected, respectively, to the strips 81 and 82 and to a short circuit bar 92 mounted on a side surface 94 of the block 76 opposite the side surface 80.

A guide rod 96 extends coaxially from the plunger 57 toward the block 76 and into an axially extending central throughbore 98 in the block 76. The guide rod 96 moving in the throughbore 98 ensures axial movement of the roller 85 along the strips 81, 82 as fluid pressure against the flexible diaphragm 60 moves the plunger 57 toward the block 76.

The sliding engagement between the arm 68 and the sides of the guide slot 72 also serves to maintain the movable portion 54 in axial alignment with the stationary portion 56.

As shown, a spring 100 is received on the rod 96 between the plunger 57 and an axially facing surface 102 of the block 76 for biasing the movable portion 54 away from the stationary portion 56.

The block 76 has an inwardly stepped surface 104 located radially inwardly of the side surface 94 mounting the short circuit bar 92 and a spring arm 106 is fixed on surface 104 and extends axially toward the plunger 52 and more specifically toward an L shaped contact arm 108 that has a portion 110 extending radially outwardly from the plunger 57, opposite the arm 68, and a portion 112 extending axially toward the spring arm 106 and to a cam surface 114 thereof. The outer end of the spring arm 106 has a curved, semi-circular portion 116 and a boss 118 located inwardly of the curved portion 106 and forming a contact on the side of the spring arm 106 facing the short circuit bar 92.

It will be understood that fluid pressure on the diaphragm 60 forces the plunger 57 toward the block 76 and the roller 85 along the strips, thereby changing the voltage drop between terminals 86, 87 and 88 connected to respective ends of the strips 81 and 82 until the cam surface 114 engages the curved portion 116 and forces the boss contact 118 against the short circuit bar 92 to short circuit the remaining resistance in the high resistance strip 81 or 82, through terminal 88, short circuit bar 92, plunger 57, spring bracket 83, roller 85 and strip 82 or 81, the short circuit of the potentiometer indicating a maximum fluid pressure. The short circuit signal can be used to supply an alarm signal to an annunciator.

The assembly 50 provides a non-arcing potentiometer. The spring bracket 83 places sufficient pressure on elastomeric conductive roller 85 that it is flattened sufficiently in the area of its contact with the strips 81 and 82 to establish a sufficient area of surface contact with the strips 81 and 82.

Also, the rod 96 movable in the throughbore 98 and arm 68 movable in the slot 72, provides and ensures aligned guiding movement of the roller 85 on the strips 81 and 82.

Figure 7A:
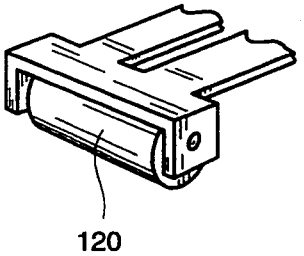
FIG. 7A is a perspective view of a yoke for mounting an elastomeric conductive roller of the assembly.
Figure 7B:
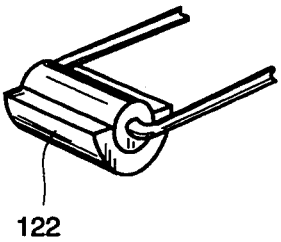
FIG. 7B is a perspective view of an elastomeric rocker shaped contact which can be used in place of the roller shown in FIG. 7A.
Figure 7C:
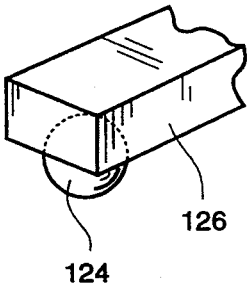
FIG. 7C is a perspective view of a rotatable ball contact which can be used in place of the roller shown in FIG. 7A.

It will be noted that: the roller 85 can be mounted in a yoke 120 as shown in FIG. 7A; a rocker 122 can be used in place of the roller 85 as shown in FIG. 7B; or the strip 82 can be omitted and the roller 85 can be replaced by a ball 124 rotatably mounted in an arm 126, the strip 81 then having a significantly high resistance, as shown in FIG. 7C.

From the foregoing description, it will be apparent that changes may be made in form, construction, and arrangement of the several parts thereof without departing from the teachings of the invention or sacrificing any of the advantages therein.

For example, the strip 81 and/or 82 can be made of a deformable conductive elastomeric material and the roller 85 can be made of a conductive metal material. In this embodiment, the roller 85 will press into the deformable conductive elastomeric strips 81 and 82 thereby to provide a sufficient area of contact between the roller 85 and the strips 81 and 82.

The preferred embodiments illustrated are not intended to be exhaustive or to limit the invention to the precise form disclosed. Accordingly, the scope of the invention is only to be limited as necessitated by the accompanying claims.

We claim:

1. A compact potentiometer assembly comprising at least one strip of electrically conductive material having a significant resistance, electrically conductive rolling contact means in direct electrical and mechanical contact with said strip, means for moving said rolling contact means along said strip, and said rolling contact means being a deformable, electrically conductive, elastomeric roller.

2. A movable electrical contact assembly forming a potentiometer and including at least one strip of electrically conductive material having a significant resistance, electrically conductive rolling contact means in contact with said strip, means for moving said rolling contact means along said strip and, said rolling contact means being a deformable, electrically conductive, elastomeric rocker.

3. A movable electrical contact assembly forming a potentiometer and including at least one strip of electrically conductive material having a significant resistance, electrically conductive rolling contact means in contact with said strip, means for moving said rolling contact means along said strip and, said rolling contact means being a deformable, electrically conductive, elastomeric ball.

4. A movable electrical contact assembly forming a potentiometer and including a first strip of electrically conductive material having a significant resistance, electrically conductive rolling contact means in contact with said strip, means for moving said rolling contact means along said strip, said rolling contact means being a deformable, electrically conductive, elastomeric roller, and a second strip of electrically conductive material having a significant resistance spaced from and generally parallel to said first strip, and said roller engaging both strips.

5. The assembly of claim 4 wherein said two strips are mounted on a stationary member and said roller is mounted on a movable member arranged for guided movement to and from said stationary member.

6. The assembly of claim 5 wherein said movable member includes a plunger having an inner end and an outer end against which a pressure can be applied for moving the plunger to move the movable member toward the stationary member.

7. The assembly of claim 6 wherein said movable member has an elongated guide member which extends from an inner end of the plunger toward and into a bore in said stationary member.

8. The assembly of claim 6 wherein said plunger has an area extending outwardly therefrom to a head mounting a spring bracket mounting said roller.

9. The assembly of claim 6 wherein said stationary member includes a plate having a planar surface on which said strips are mounted.

10. The assembly of claim 9 wherein said plate has a slot therein and said plunger has an arm which is slidingly received in said slot, such sliding engagement serving to guide movement of said arm and therefore movement of said roller.

11. The assembly of claim 6 wherein said plunger has a second arm extending outwardly therefrom to a cam surface and said stationary member has a spring arm extending therefrom and a short circuit element therein, said cam surface being movable against said spring arm to force same into contact with said short circuit element to short circuit said high resistance strip, the short circuit being used as an alarm signal which is supplied to an annunciator.

12. A movable electrical contact assembly forming a potentiometer and including at least one strip of electrically conductive material having a significant resistance, electrically conductive rolling contact means in contact with said strip, means for moving said rolling contact means along said strip, and said strip being made of a deformable, electrically conductive, elastomeric material and said rolling contact means being made of an electrically conductive metal.

* * * * *